US006711858B1

(12) United States Patent
Albanese et al.

(10) Patent No.: US 6,711,858 B1
(45) **Date of Patent: *Mar. 30, 2004**

(54) PILE WEATHERSTRIPPING

(75) Inventors: James V. Albanese, Lyons, NY (US); David N. Hawkins, Macedon, NY (US)

(73) Assignee: Ultrafab, Inc., Farmington, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 28 days.

(21) Appl. No.: 09/656,769

(22) Filed: Sep. 7, 2000

(51) Int. Cl.[7] ..... D04D 9/04; E06B 7/16

(52) U.S. Cl. ..... 49/475.1; 49/479.1; 49/489.1; 49/195.1; 442/269; 428/93; 428/95

(58) Field of Search ..... 428/93, 95; 49/475.1, 49/489.1, 479.1, 495.1; 296/216.07, 216.06, 216.09, 3; 442/269

(56) References Cited

U.S. PATENT DOCUMENTS

| | | | | |
|---|---|---|---|---|
| 1,895,293 A | | 1/1933 | Morton | |
| 2,989,766 A | * | 6/1961 | Hoag | 15/161 |
| 3,404,487 A | * | 10/1968 | Johnson | 156/72 |
| 3,690,038 A | * | 9/1972 | Dieterich | 49/489.1 |
| 4,022,642 A | | 5/1977 | Abel | |
| RE30,359 E | | 8/1980 | Metzler | |
| 4,288,482 A | | 9/1981 | Beck | |
| 4,288,483 A | | 9/1981 | Miska et al. | |
| 4,302,494 A | | 11/1981 | Horton | |
| 4,866,808 A | * | 9/1989 | Zuiddam et al. | 15/161 |
| 5,093,181 A | | 3/1992 | Sanchez | |
| 5,472,762 A | | 12/1995 | Edwards et al. | |
| 5,547,732 A | | 8/1996 | Edwards et al. | |
| 5,681,637 A | | 10/1997 | Kessler et al. | |
| 5,807,451 A | | 9/1998 | Johnson | |
| 5,817,390 A | | 10/1998 | Johnson | |
| 6,024,815 A | | 2/2000 | Norton | |

FOREIGN PATENT DOCUMENTS

| | | | | |
|---|---|---|---|---|
| DE | 002060242 A | * | 12/1972 | 49/489 |
| IT | 293049 | * | 10/1930 | |
| IT | 000293049 A | * | 1/1936 | 49/489.1 |
| WO | WO 96/06965 | | 3/1996 | |

* cited by examiner

*Primary Examiner*—Ula Ruddock
*Assistant Examiner*—Jennifer Boyd
(74) *Attorney, Agent, or Firm*—Kenneth J. Lukacher; Martin Lukacher

(57) ABSTRACT

Pile weatherstripping is provided by a flat pile of strands which are tensioned to spring outwardly to straight condition to provide a pile weatherstrip, when bent and inserted into a T-slot or other kerf in a member such as a window or door frame or sash. The tendency of the bent parts of the pile to spring away from each other facilitates retention of the pile after insertion into the slot. A locking fin, more rigid than the pile, is preferably used. This locking fin engages steps or edges in the throat of the slot thereby impeding withdrawal of the weatherstripping from the slot. One or more barrier fins may also be assembled with the strands constituting the flat pile. The pile can be operated in bending mode or in columnar compression (crushing mode). Bending mode operation can be over a bending range so as to accommodate a large range of clearance between a sash and a frame or other members which are sealed by the pile weatherstripping. Parts of the pile can have desired lateral spacing and angular orientation with respect to each other (contour) by using spacing and/or contour forming elements assembled with the flat pile. Since the pile is flat until installed, it is readily wound on reels for shipment and storage until installation. Installation may be accomplished by a roller which pushes the flat pile into the slot. The slot may be disposed at an angle or in a corner of the member to be sealed and facilitates sealing around the entire perimeter of a surface to be sealed such as the exterior surfaces of a window sash or a frame in which this sash is movable.

44 Claims, 4 Drawing Sheets

PILE WEATHERSTRIPPING

DESCRIPTION

The present invention relates to pile weatherstripping and more particularly to a pile weatherstrip which is formed by bending and insertion of a strip of side-by-side strands of flat pile into a kerf or other slot in a member for providing sealing action along a surface of the member through which the pile extends.

It is a feature of the present invention to provide pile weatherstripping which is formed from flat pile. Another feature of the invention is to provide pile weatherstripping which is operable in compression or in a bending mode. In the bending mode, the pile can bend over a range covering different size clearances between members to be sealed. A single size of flat pile can form weatherstripping which covers a large range which may be approximately 100 mils (0.100 inch) of clearance, or more. Still another feature of the invention is to provide weatherstripping which may be manufacturable at lower cost than weatherstripping which has been heretofore available, such as of the type shown in Johnson, U.S. Pat. No. 5,807,451, issued Sep. 15, 1998, or Miska, U.S. Pat. No. 4,288,483, issued Sep. 8, 1981.

Pile weatherstripping has conventionally been provided by piles which project upwardly into a brush, rather than are formed into a brush providing the pile seal upon insertion in the pile receiving slot. Even when strands are wound around a loop and cut into sections, the winding provides bush-like structure with bases or cores to facilitate holding the pile in the slot. See for example, the above cited patents and Metzler, U.S. Pat. Re. No. 30,359, issued Aug. 5, 1980.

The range of flexure of conventional pile weatherstripping may be limited when the sealing action is accompanied by the crushing of the pile. Such crushing mode operation can exert forces sufficient to bind the movable sealed unit, such as a sash of a window or door frame, which prevents opening of the window or door without more than desirable force. In other words, the stiff strands apply pressure on the sash and cause binding on the sides of the sash. The present invention provides a sash which can operate in a bending mode; providing sealing without significant crushing of the pile and enabling the pile to bend over a range, commensurate with the height of the pile, over the surface of the member through which the pile extends. The stiffness and height of the pile are therefore controllable. Moreover when barrier fins are used, the bending action also bends the fin rather than causes crenellation which detracts from the sealing action.

Pile weatherstrip provided by the invention may utilize a locking fin on the outside of the flat pile. The inside of the pile is defined by the parts, around the bend, formed when the flat pile is inserted in the slot, which parts face each other. With a locking fin, the force to insert the weatherstripping, preferably by rolling into the slot, is much less than the force to remove the weatherstripping.

In order to control compressive forces exerted by the pile in the crushing mode, the density of the pile (strands per given area) has been reduced, sacrificing the sealing action of the pile. Pile weatherstripping in accordance with the invention can be operated in the crushing mode if desired and without sacrificing the sealing action thereof.

Another advantage of the flat pile weatherstripping provided by the invention is that it is adapted to be assembled by welding, for example, with a bead (a filament) which extends along the inside of the pile. The use of a locking fin facilitates distribution of ultrasonic welding energy and avoids burning of the strands. Locking fins thus afford a further advantage when used in weatherstripping provided by the invention. The lateral spacing of the bent parts (tufts) of the weatherstrip is a function of the diameter of the bead and the width of the T-slot. The compressibility of the pile, even in the crushing mode, may be selectable in accordance with the diameter of the bead and without sacrificing the density and sealing effectivity of the pile. Selectability of bead diameter is still another feature of the invention.

Weatherstripping provided by the invention may readily be made by winding processes which maintain the strands under tension so as to pre-stress or bias the strands to return to straight condition, thus providing a pile which tends to lie flat. Winding processes for making flat pile are similar to those used in weaving and may be of the type described in U.S. Pat. No. 4,022,642, issued May 1977 to Abel, and U.S. Pat. No. 1,895,293, issued January 1933 to Morton.

Another advantage of the invention is to provide weatherstripping which is easy to store and may be wound flat around a reel for shipping or storage. Furthermore, the winding can be at higher density and without capturing significant air, and thus the amount of linear footage that can be stored on a standard reel is substantially increased over conventional weatherstripping. Still another advantage of the invention is that the pile may be formed into a slot which may be other than perpendicular to a flat surface of the member to be scaled. The slot may be disposed at an angle less than 90 degrees and even in to a corner of the member.

Briefly described, a pile weatherstrip in accordance with the invention forms a flexible seal projecting from the member to be sealed when received in a holding slot in the member. The slot may, as conventional, extend longitudinally of the member. The slot has a throat which defines steps along opposite edges of the throat internally of the slot. The slot may be a kerf where the throat is provided by teeth which define the edges. A plurality of strands are stacked in side-by-side relationship to provide a flat pile. The strands have resiliency tending to maintain them straight, that is, perpendicular to a longitudinal axis, about which the flat pile defined by the strands is bent. Upon insertion into the slot, the strands are bent inwardly, along the axis which divides the pile into separate parts. These parts are tensioned, because of the tension in the strands, to spring outwardly. Preferably, a locking fin on the outside of the flat pile, is located internally of the slot, and engages the edges at the throat as the locking, fin spring outwardly, so as to retain the weatherstripping in the slot. End portions of the parts of the strands extend outwardly from the slot and define the flexible pile seal.

The foregoing and other features, objects, and advantages of the invention will become apparent from a reading of the following description in connection with the accompanying drawings in which.

Figure 7A:
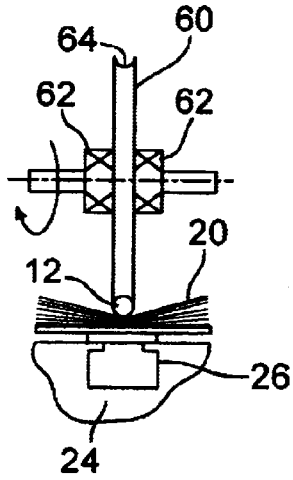
Figure 7B:
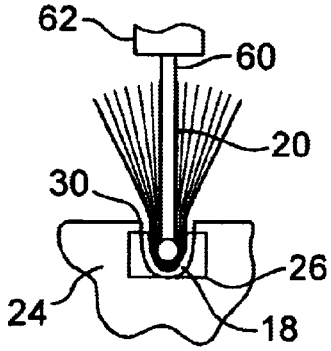
Figure 7C:
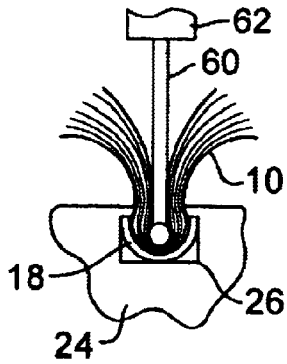
Figure 8A:
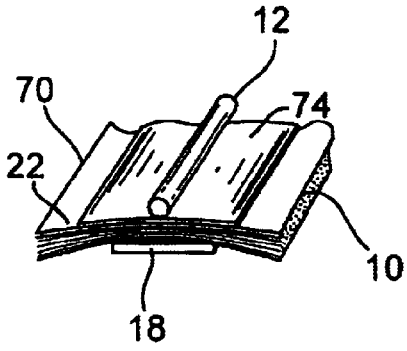
Figure 8B:
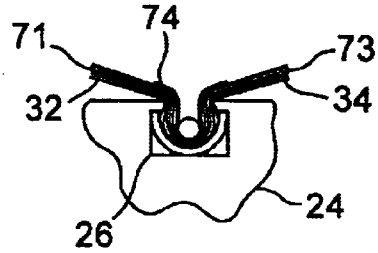
Figure 9A:
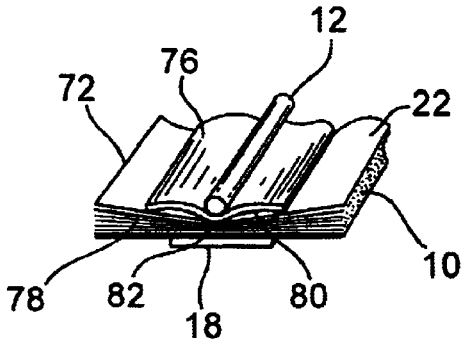
Figure 9B:
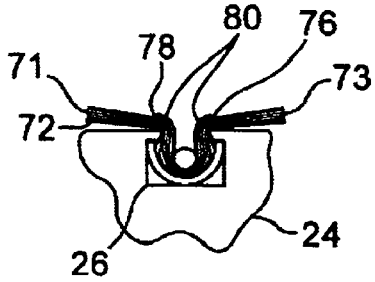

FIGS. 7A, 7B, and 7C are schematic diagrams illustrating rolling of the flat pile weatherstripping to install same in the slot or kerf in the member to be sealed;

FIGS. 8A and 8B show a flat pile and the weatherstripping formed therefrom, respectively, in accordance with another embodiment of the invention;

FIGS. 9A and 9B show still another flat pile and the weatherstripping formed therefrom, respectively, in accordance with still another embodiment of the invention.

Figure 1:
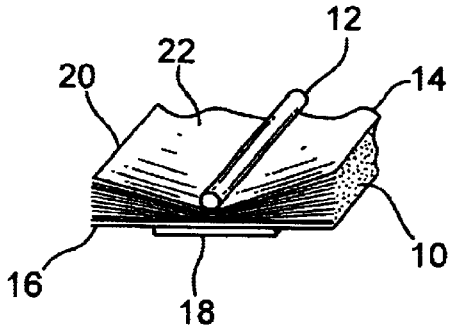
FIG. 1 is a perspective view of a flat pile in accordance with the invention.

Referring to FIG. 1, there is shown a stack of strands which form a flat pile 10. The strands are tensioned outwardly so that the strands tend to lie flat in the pile 10. The pile may be made of a polyolefin yarn, preferably polypropylene, which is ultrasonically weldable. A monofilament thread or bead 12 extends along the center of the pile on the inside 14 thereof. This monofilament may be a polyolefin material or any other ultrasonically meltable and weldable material such as nylon. Opposed to the bead 12, on the outside 16 of the pile 10, is a locking fin 18 also of ultrasonically weldable material. This fin may be thicker than the strands forming the pile, while the resilience is of the fin 18 greater (more rigid) than the pile. The requisite resiliency may be obtained by selecting the thickness of the fin 18. The fin is centered along the center of the pile 10 (a longitudinal axis along the center of the width of the pile). An ultrasonic horn is preferably used to compress the bead 12 against the fin 18 thereby compressing the pile along the center axis thereof, and melting the bead, pile and locking fin 18, thereby welding them together and assembling them into the flat pile weatherstrip 20. If desired, a barrier fin 22 of a width which may be equal to the width of the pile as shown or greater than the width of the pile or even somewhat less than the width of the pile, so as to enhance the sealing action of the pile. This fin 22 may be referred to as a glide fin.

Another similarly sized glide fin (not shown) may be provided on the outside 16 of the pile 10 between the pile and the lock fin 18. All these fins are of ultrasonically weldable material and are assembled into the flat pile weatherstripping by adhering the bead 12, pile 10, lock fin 18 and the glide fins to each other, preferably by ultrasonic welding.

The pile tends to be a flat pile because of the tension in the strands of the pile which is permanently set when the strands are wound or woven during formation of the pile.

Figure 2:
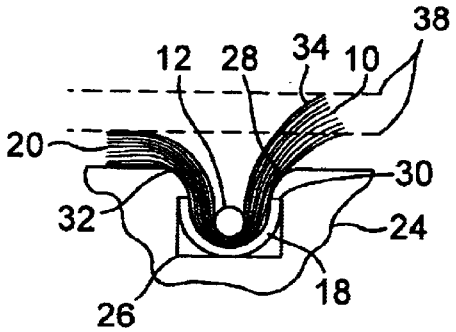
FIG. 2 is a cross sectional view showing the pile weatherstripping formed from the flat pile disposed in a slot.

FIG. 2 illustrates a frame or member 24, such as a sash or window frame, having a T-slot 26. The member 24 may, for example, be an extrusion of plastic material, usually vinyl, which forms the sash or frame of a window in which the pile 20 is installed. The T-slot 26 has a throat or neck 28 of a width greater than the diameter of the bead 12. Under the neck 28 are steps 30. The flat pile is bent about the bead 12 into parts (sides) 32 and 34 which flare away from each other. The angular extent of the flare, or the angle between the parts 32 and 34, is determined by the width of the slot 26, and the diameter of the bead 12.

The lock fin 18 enters the slot 26 and engages the steps 30 under the neck 28 of the slot. The engagement is along the edges of the lock fin 18. Accordingly, when the weatherstrip is bent and inserted into the slot 26, it is installed in a way to impede removal. In order to remove the weatherstrip 12, a hook blade may be inserted into the slot 26, past the neck 28 to engage and depress the lock fin along one side thereof so as to allow the weatherstrip 20 to be pulled from the slot. Otherwise, the lock fin 18 permanently locks the weatherstrip in the slot 26.

The weatherstrip 20, as shown in FIG. 2, is designed to operate in a bending mode. When in that mode, weatherstrip is capable of forming a seal over an operating range as for example, indicated by the dash lines 38. The weatherstrip 20 is therefore able to accommodate a large range of clearance between the member 24 and another member which is movable toward and away from the extrusion member 24. This operating range may, for example, be 100 mils, or more. Thus a single weatherstrip size may be used to accommodate a large range of closing clearances as between a window sash and frame.

Figure 4:
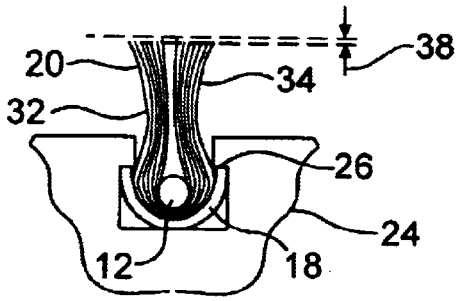
FIG. 4 is a view similar to FIG. 2 showing another installation of pile weatherstripping in accordance with the invention.

The weatherstrip 20 may, as shown in FIG. 4, be operable in compression or crushing mode, where the parts or sides 32 and 34 extend generally perpendicular to the surface of the extrusion member 24. Such a more perpendicular relationship than shown in FIG. 2 is obtained by reducing the distance between the bead 12 and the side walls of the throat, that is the spacing between the bead and the side walls of the throat. This may be accomplished with a smaller width T-slot 26. As the width of the slot axis is reduced, the pile becomes more perpendicular in the slot. In the compression or crushing mode, the operating range, that is the distance between the dash lines 38, is smaller than in the case where the weatherstripping is configured to operate in the bending mode as shown in FIG. 2.

Figure 3:
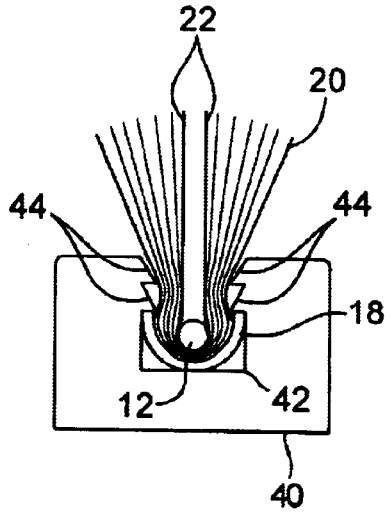
FIG. 3 is a view similar to FIG. 2 showing the pile disposed in a kerf.

Referring to FIG. 3, the weatherstrip 20 is shown installed in an extrusion member 40 having a kerf 42, which is a slot having teeth or grip edges 44 extending along the kerf slot 42. The lock fin 18 engages the grip edges 44 when the pile 20 is received in the kerf 42.

Figure 5:
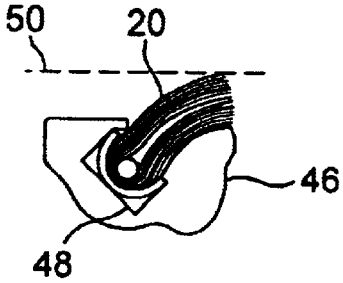
FIG. 5 is a view similar to FIG. 1 showing still another installation of weatherstripping in accordance with the invention, wherein the slot is disposed at a non-perpendicular angle to the surface of the member to be sealed.
Figure 6:
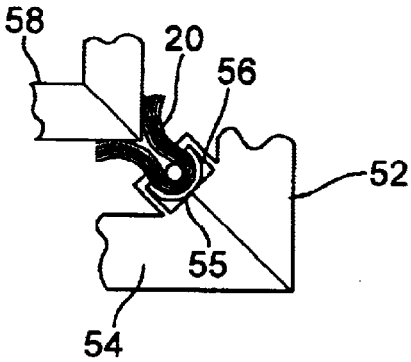
FIG. 6 is a view similar to FIG. 1 showing the slot and weatherstripping installed in a corner of the member to be sealed.

Referring to FIG. 5, there is shown a slot 48 disposed at an acute angle to the surface of the extrusion member 46 from which the pile 20 extends. The pile operates in a bending mode over a large clearance range where the sash surface 50 approaches the surface of the extrusion member 46, which may be a window frame. As shown in FIG. 6, the pile weatherstripping 20 may be used in the corner of a member, such as the corner of a window frame formed by side and bottom extrusion members 52 and 54. The pile 20 is received in a T-slot 56. As the sash 58 approaches the frame, the weatherstripping 20 bends at the corner of the sash 58 providing a seal. The weatherstrip may be a continuous weatherstrip which extends around the corner 55. Then the T-slot 56 is internally of the members 52 and 54. A single weatherstrip may then be used to seal the bottom 54 and the sides 52 of the frame.

FIGS. 7A, 7B, and 7C illustrates the installation of the weatherstrip 20 by means of a roll in wheel 60 which is journaled in bearings 62. The edge 64 of the wheel may be concave so as to ride on the bead 12. As the extrusion and weatherstrip 20 move together past the wheel 60, and the wheel 60 is brought down into the slot 26, the weatherstrip 20 is bent as shown in FIG. 7B. There the lock fin 18 is still within the neck 30 of the slot 26.

As the wheel 60 is brought down further into the slot, as shown in FIG. 7C, the lock fin 18, due to its resiliency and greater rigidity than the pile 10, springs laterally outward and locks the weatherstrip 20 in the slot 26.

FIGS. 8A and 9A show flat weatherstrips 70 and 72, which are similar to the weatherstrip 20 and like parts are identified with like reference numerals. Pile contouring fins 74 and 76 in the form of strips of material which is resilient but more rigid than the pile 10 are assembled into the flat pile. More particularly, the contour fins 74 and 76 are strips which are centered with respect to the pile 10 (midway between the outer edges of the pile 10), and are sandwiched between the pile or the slide fin 22, when that fin 22 is used on the inside of the pile, and the bead 12. These contouring fins are assembled with the pile, lock fin 18 and bead 12 as a unitary assembly, preferably by ultrasonic welding. The material of the contouring fins 74 and 76 may be the same as used for the lock fin 18. Preferably the rigidity of the contouring fins 72 and 74 is between the rigidity of the pile and the rigidity of the lock fin.

The contouring fin 74 is arcuately shaped and retains the arcuate shape when the weatherstrip 70 is inserted in the slot 26 as shown in FIG. 8B. The contouring fin 74 defines the contour or flare of the sides 32 and 34 of the pile 10, which generally follow the contour of the contour fin 74. The installation of an arcuate contouring fin 74 is shown in FIG. 8B.

The installation of the weatherstrip 72 in the T-slot 26 in the member 24 is shown in FIG. 9B. The contouring fin 76, like the fin 74, is of a width less than the width of the flat pile 10 and centered between the outer edges 71 and 73 of the pile. The contouring fin 76, like the fin 74, is of sufficient width to extend out of the slot 26 when the pile is installed in the slot. The contouring fin 76 is wavy in cross section, that is, it has side arms 78 and 80 of convex shape extending from a central section 82 of convex shape. The concave side arms 78 and 80 are spaced further from the edges of the T-slot 26, at the surface of the member, than is the case for the arcuate shaped contouring fin 74, and thus defines a somewhat shallower flare or contour than the contouring fin 74. By selecting the radius of the arc, both of the contouring fin 74 or of the arms 78 and 80 of the contouring fin 76, the amount of feathering or tapering of the pile parts 32 and 34 and the amount of initial bending of the flat pile, and its desired contour, is obtainable. From the foregoing description it will be apparent that there has been provided improved pile weatherstripping, and particularly flat pile weatherstrips, which may operate either in bending or compression modes and assume desired shapes upon installation. Additional shapes of the pile and other variations and modifications thereof, within the scope of the invention, will become more apparent to those skilled in the art. Accordingly the foregoing description and drawings should be taken as illustrative and not in a limiting sense.

What is claimed is:

1. A pile weatherstrip which forms a flexible seal projecting from a member in a holding slot extending longitudinally along the member, the slot having a throat which defines steps along opposite edges of the throat internally of the slot, said weatherstrip comprising a plurality of strands in side-by-side relationship, which said strands have resiliency to straighten thereby thereby defining and maintaining said strands in a flat pile which flat pile also extends longitudinally, said pile weatherstripping being formed with said flat pile being disposed in said slot bent upwardly along an axis also extending longitudinally of said slot and across said stands, and dividing said strands into separate parts tensioned to spring outwardly against said steps into holding relationship therewith, said holding relationship being provided by portions of said parts being disposed internally of said slot engaging said steps to hold said bent flat pile in said slot, exterior portions of said parts extending outwardly of said slot to define said flexible seal.

2. The weatherstrip according to claim 1 wherein said exterior portions extend from said member over a distance defining a sealing range over which said exterior parts bend about said member away from each other when engaged by another member to form the seal between said members.

3. The weatherstrip according to claim 1 wherein said slot and said throat extend along an acute angle inwardly from a surface of said member at which said sealing action is provided by said bent strands which extend from said surface to provide said seal.

4. The weatherstrip according to claim 1 wherein said slot intersects a corner of said member and said parts of said pile are disposed on opposite sides of said corner to provide a seal along said corner.

5. The weatherstrip according to claim 1 wherein a flexible rib is disposed along said axis and assemble said strand into said flat pile.

6. The weatherstrip according to claim 5 wherein said rib is a bead, said bead and said strands being disposed in adhering relationship so as to assemble said strands into said flat pile.

7. The weatherstrip according to claim 1 wherein a fin of flexible material along the outside of said flat pile, where said pile bends about said axis, provides a locking fin which engages said steps along edges of said fin to retain said bent pile in said slot.

8. The weatherstrip according to claim 7 wherein said locking fin is of material which is flexible but more rigid than said pile.

9. The weatherstrip according to claim 1 wherein a web of flexible material is disposed along said pile and is of sufficient width to extend outwardly of said slot with said parts of said bent strands which provide said seal to form an internal fin in said seal.

10. The weatherstrip according to claim 9 wherein said internal fin is less rigid than said locking fin.

11. The weatherstrip according to claim 10 wherein said internal fin has edges which extend at least to the upper ends of said pile.

12. The weatherstrip according to claim 10 wherein said fins and strands are of like material.

13. The weatherstrip according to claim 12 wherein said material is a polyolefin which is ultrasonically weldable.

14. The weatherstrip according to claim 10 further comprising a filament extending along said axis on the inside of said bend, said filament, internal fin and locking fin and strands being welded together to assemble said weatherstrip.

15. The weatherstrip according to claim 1 wherein said slot is a kerf and said throat has teeth defining edges which engage said pile.

16. The weatherstrip according to claim 1 wherein said slot is a kerf having grip edges, a locking fin attached to said pile on the outside thereof for engaging said edges when said pile is received in said kerf.

17. The weatherstripping according to claim 5 wherein said rib is a bead of diameter selected to provide separation of said parts of said pile when disposed in said slot.

18. The weatherstripping according to claim 6 wherein said bead is a monofilament of ultrasonically meltable and weldable material.

19. The weatherstrip according to claim 1 wherein a fin of flexible material more rigid than said strands and shorter than said flange but long enough to extend out of said slot when said flat pile is disposed in said slot is assembled centrally of said flat pile on the inside thereof whereby to define the contour of said parts projecting from said slot.

20. The weatherstrip according to claim 7 further comprising a fin of flexible material more rigid than said strands and shorter than said flange but long enough to extend out of said slot when said flat pile is disposed in said slot is assembled centrally of said flat pile on the inside thereof whereby to define the contour of said parts projecting from said slot.

21. The weatherstrip according to claim 19 wherein said contour defining fin has a middle section from which arcuate side sections extend.

22. A pile weatherstrip in a slot in a member comprising a plurality of transversely oriented strands spaced in a longitudinal direction, said strands having a tendency to lie flat, such that said strands define a flat pile, said strands being connected together along a longitudinal axis extending between opposite ends of said strands, said flat pile being deformed when installed in said slot such that said pile extends upwardly from said slot.

23. The weatherstrip in the slot in the member according to claim 22 further comprising a monofilament thread or bead extending in said longitudinal direction across said transversely oriented strands of said pile and being attached thereto.

24. The weatherstrip in the slot in the member according to claim 22 further comprising a locking fin disposed over and extending longitudinally along the transversely oriented strands and being attached thereto.

25. The weatherstrip in the slot in the member according to claim 22 further comprising a monofilament thread or bead extending in said longitudinal direction, said transversely oriented strands being disposed between the ends thereof on said monofilament thread or bead, a locking fin disposed over and extending along said pile in alignment with the monofilament thread or bead, said monofilament thread or bead, locking fin and pile being assembled together along said axis.

26. The weatherstrip in the slot in the member according to claim 25 wherein said ultrasonic weld welds together said strands, thread or bead, and said locking fin to assemble said strands, thread or bead, and locking fin.

27. The weatherstrip in the slot in the member according to claim 22 wherein said pile extends from said slot from said member a distance defining a sealing range over which parts of said pile on opposite sides of said axis bend about said member away from each other when engaged by another member to form a seal between said members.

28. The weatherstrip in the slot in the member according to claim 27 wherein said slot extends along an acute angle from a surface of said member at which sealing action is provided by said bent pile which extends from said member.

29. The weatherstrip in the slot in the member according to claim 28 wherein said slot intersects a corner of said member and said parts of said pile are disposed on opposite sides of said corner to provide a seal along said corner.

30. The weatherstrip in the slot in the member according to claim 23 wherein said strands are disposed in adhering relationship with said monofilament thread or bead so as to assemble said strands into said flat pile.

31. The weatherstrip in the slot in the member according to claim 24 wherein said locking fin is a flexible material disposed along the outside of said flat pile, and said locking fin engages edges internal of said slot to retain said bent pile in said slot.

32. The weatherstrip in the slot in the member according to claim 31 wherein said locking fin is of material which is flexible but more rigid than said pile.

33. The weatherstrip in the slot in the member according to claim 25 wherein said locking fin is generally centered over and extending longitudinally with the monofilament thread or bead with the transversely oriented strands therebetween.

34. The weatherstrip in the slot in the member according to claim 32 further comprising a web of flexible material disposed along the inside of said pile and is of sufficient width to extend outwardly of said slot with said pile thereby forming an internal fin in said weatherstrip.

35. The weatherstrip in the slot in the member according to claim 34 further comprising a fin of flexible material disposed on the outside of said flat pile generally centered over said strands where said pile deformation is bending thereof upon installation into said slot, said fin providing a locking fin having longitudinal edges which engages steps internally of said slot to retain said bent pile in said slot, and wherein said internal fin is less rigid than said locking fin.

36. The weatherstrip in the slot in the member according to claim 35 wherein said internal fin has edges which extend at least to the upper ends of said strands constituting said pile.

37. The weatherstrip in the slot in the member according to claim 36 wherein said fins and strands are of like material.

38. The weatherstrip in the slot in the member according to claim 37 wherein said material is a polyolefin which is ultrasonically weldable.

39. The weatherstrip in the slot in the member according to claim 35 further comprising a monofilament thread or bead extending along said axis on the inside of said pile, said monofilament thread or bead, internal fin and locking fin and strands being welded together to assemble said weatherstrip.

40. The weatherstrip in the slot in the member according to claim 22 wherein said slot is a kerf having a throat with teeth defining edges which engage said pile upon installation into said slot.

41. The weatherstrip in the slot in the member according to claim 40 further comprising a locking fin attached to said pile on the outside thereof having edges for engaging said teeth when said pile is received in said kerf.

42. The weatherstrip in the slot in the member according to claim 23 wherein said thread or bead has a diameter selected to provide separation of parts of said pile on opposite sides of said axis from said thread or bead when disposed in said slot.

43. The weatherstrip in the slot in the member according to claim 35 wherein said internal fin is of flexible material more rigid than said strands and shorter than said strands but long enough to extend out of said slot when said flat pile is disposed in said slot, said internal fin being assembled with said strands centrally of said pile on the inside thereof whereby to define the contour of parts of said pile which extend transversely from the center thereof.

44. The weatherstrip in the slot in the member according to claim 43 wherein said internal fin has a middle section from which arcuate side sections extend.

* * * * *